US005619965A

United States Patent [19]

Cosma et al.

[11] Patent Number: 5,619,965

[45] Date of Patent: Apr. 15, 1997

[54] CAMLESS ENGINES WITH COMPRESSION RELEASE BRAKING

[75] Inventors: Gheorghe Cosma, Windsor; James Usko, North Granby, both of Conn.

[73] Assignee: Diesel Engine Retarders, Inc., Wilmington, Del.

[21] Appl. No.: 409,646

[22] Filed: Mar. 24, 1995

[51] Int. Cl.[6] ..... F02D 13/04; F01L 9/02

[52] U.S. Cl. ..... 123/322; 123/90.12

[58] Field of Search ..... 123/90.12, 90.13, 123/320, 321, 322

[56] References Cited

U.S. PATENT DOCUMENTS

| | | | |
|---|---|---|---|
| 3,220,392 | 11/1965 | Cummins | 123/321 |
| 3,682,152 | 8/1972 | Müller-Berner | 123/90.11 |
| 3,727,595 | 4/1973 | Links | 123/90.12 |
| 3,738,337 | 6/1973 | Massie | 123/90.12 |
| 3,926,159 | 12/1975 | Michelson et al. | 123/90.11 |
| 4,000,756 | 1/1977 | Ule et al. | 137/596.17 |
| 4,009,695 | 3/1977 | Ule | 123/90.13 |
| 4,188,925 | 2/1980 | Jordan | 123/90.12 |
| 4,206,728 | 6/1980 | Trenne | 123/90.12 |
| 4,392,459 | 7/1983 | Chareire | 123/21 |
| 4,664,070 | 5/1987 | Meistrick et al. | 123/21 |
| 4,791,895 | 12/1988 | Tittizer | 123/90.12 |
| 4,957,074 | 9/1990 | Weissler, II et al. | 123/90.11 |
| 4,974,495 | 12/1990 | Richeson, Jr. | 91/459 |
| 5,022,358 | 6/1991 | Richeson | 123/90.12 |
| 5,113,812 | 5/1992 | Rembold et al. | 123/90.12 |
| 5,117,790 | 6/1992 | Clarke et al. | 123/321 |
| 5,121,723 | 6/1992 | Stepper et al. | 123/322 |
| 5,129,369 | 7/1992 | Kawamura | 123/90.11 |
| 5,146,890 | 9/1992 | Gobert et al. | 123/321 |
| 5,170,755 | 12/1992 | Kano et al. | 123/90.17 |
| 5,190,262 | 3/1993 | Wollatt | 251/48 |
| 5,193,495 | 3/1993 | Wood, III | 123/90.12 |
| 5,201,296 | 4/1993 | Wunning et al. | 123/479 |
| 5,221,072 | 6/1993 | Erickson et al. | 251/30.05 |
| 5,224,683 | 7/1993 | Richeson | 251/30.01 |
| 5,231,959 | 8/1993 | Smietana | 123/90.12 |
| 5,237,968 | 8/1993 | Miller et al. | 123/90.11 |
| 5,237,976 | 8/1993 | Lawrence et al. | 123/90.12 |
| 5,248,123 | 9/1993 | Richeson et al. | 251/29 |
| 5,255,641 | 10/1993 | Schechter | 123/90.11 |
| 5,255,650 | 10/1993 | Faletti et al. | 123/322 |
| 5,271,229 | 12/1993 | Clarke et al. | 60/605.1 |
| 5,275,136 | 1/1994 | Schechter et al. | 123/90.12 |
| 5,373,817 | 12/1994 | Schechter et al. | 123/90.12 |
| 5,375,419 | 12/1994 | Wright et al. | 60/607 |
| 5,404,844 | 4/1995 | Schechter | 123/90.12 |

FOREIGN PATENT DOCUMENTS 1395027 5/1975 United Kingdom .

OTHER PUBLICATIONS

Patent Abstracts of Japan, vol. 9, No. 51 (M-361), Mar. 6, 1985 (abstract for Japanese patent application JP A 59 188016, Oct. 25, 1984).

*Primary Examiner*—Willis R. Wolfe

*Attorney, Agent, or Firm*—Fish & Neave; Robert R. Jackson

[57] ABSTRACT

A camless internal combustion engine has electronically or computer controlled, electrically operated hydraulic actuators for selectively opening the engine cylinder valves. The engine is capable of operating in either positive power mode or compression release engine braking mode. The pressure of the hydraulic fluid available for application to the hydraulic actuators is automatically adjusted from a relatively low pressure during positive power mode to a relatively high pressure during compression release engine braking mode. The stroke lengths of the engine cylinder valves may be automatically adjusted for various engine operating conditions using feedback loops that include sensors for detecting the amount of opening of each engine cylinder valve whose stroke length is to be controlled in this manner. The shapes of the valve opening and closing trajectories as a function of engine crank angle may similarly be varied in many other respect.

27 Claims, 6 Drawing Sheets

10
20
22
30
32
40
50
60
62
64
70
72
74
80
90
100
110
112
114
116
118a
118b
118c
120
122
124
126
128a
128b
128c
130

CAMLESS ENGINES WITH COMPRESSION RELEASE BRAKING

BACKGROUND OF THE INVENTION

This invention relates to camless internal combustion engines, and more particularly to providing compression release braking and other enhancements for such engines.

Most conventional internal combustion engines have rotating cams for causing the intake and exhaust valves in the engine cylinders to open and close at the appropriate times relative to reciprocation of the pistons in the cylinders. This type of engine construction has some limitations which have prompted consideration of alternative means for opening the intake and exhaust valves. For example, with cams for opening the cylinder valves it is difficult or impossible to adjust valve timing for different engine operating conditions (e.g., different engine speeds). The engine is therefore typically constructed so that it has optimum valve timing under one set of operating conditions (e.g., at a particular engine speed), thereby leaving valve timing somewhat suboptimal for other operating conditions (e.g., at other engine speeds). The amounts by which the valves open are also difficult or impossible to adjust for various operating conditions of engines with cams. Again, the engine is therefore typically constructed so that it has fixed valve openings which may be better for some engine operating conditions than for other engine operating conditions.

Because of the difficulty or impossibility of adjusting such parameters as valve timing and stroke in conventional internal combustion engines, various "camless" engines have been proposed. For example, Ule U.S. Pat. No. 4,009,695 purports to show engines in which the intake and exhaust valves are opened and closed by hydraulic actuators. The application of hydraulic fluid to these actuators is controlled by electrically operated hydraulic valves.

With many engines it is desirable to have both a positive power mode of operation (in which the engine produces power for such purposes as propelling an associated vehicle) and a braking mode of operation (in which the engine absorbs power for such purposes as slowing down an associated vehicle). As shown, for example, by Cummins U.S. Pat. No. 3,220,392, it is well known that a highly effective way of operating an engine in braking mode is to cut off the fuel supply to the engine and to then open the exhaust valves in the engine near top dead center of the compression strokes of the engine cylinders. This allows air that the engine has compressed in its cylinders to escape to the exhaust system of the engine before the engine can recover the work of compressing that air during the subsequent "power" strokes of the engine pistons. This type of engine braking is known as compression release engine braking.

It takes a great deal more force to open an exhaust valve to produce a compression release event during compression release engine braking than to open either an intake or exhaust valve during positive power mode operation of the engine. During positive power mode operation the intake valves typically open while the piston is moving away from the valves, thereby creating a low pressure condition in the engine cylinder. Thus the only real resistance to intake valve opening is the force of the intake valve return spring which normally holds the intake valve closed. Similarly, during positive power mode operation the exhaust valves typically open near the end of the power strokes of the associated piston after as much work as possible has been extracted from the combustion products in the cylinder. The piston is again moving away from the valves and the cylinder pressure against which the exhaust valves must be opened is again relatively low. (Once opened, the exhaust valves are typically held open throughout the subsequent exhaust stroke of the associated piston, but this only requires enough force to overcome the exhaust valve return spring force.)

During compression release engine braking, however, a much greater force is required to open the exhaust valves to produce a compression release event because such events are produced near top dead center of engine compression strokes when the gas pressure in the engine cylinders is close to a maximum. If the engine is a camless engine of the type in which the valves are opened by hydraulic actuators, very high pressure hydraulic fluid may have to be supplied to ensure that there is sufficient force available to open the exhaust valves during compression release engine braking. For example, the necessary hydraulic fluid pressure may be approximately 3,000–4,000 psi.

It is not a problem or even a disadvantage to provide high pressure hydraulic fluid during engine braking because the more energy the engine absorbs in this operating mode, the more braking it produces. During positive power mode operation, however, it is undesirable for the engine to be required to pump hydraulic fluid to such high pressures because this reduces the power available from the engine for useful, vehicle-propelling work.

In view of the foregoing, it is an object of this invention to improve the performance of camless engines in which the valves are opened hydraulically and which are capable of operating in a compression release engine braking mode as well as in a positive power mode.

It is a more particular object of this invention to avoid wasteful pumping of hydraulic fluid to very high pressures which are not needed during positive power mode operation of a camless engine, even though such high pressure hydraulic fluid may be needed during compression release engine braking mode operation of the engine.

Another characteristic of engine operation which it may be desirable to change when switching from positive power mode to compression release engine braking mode (or even when operating conditions change significantly within either of these two modes of engine operation) is the amount by which some or all of the valves in the engine cylinders open. For example, because exhaust valves open near top dead center of compression strokes of the engine cylinders during compression release engine braking, it may be desirable to reduce the exhaust valve stroke during engine braking to ensure that the exhaust valves do not hit the top of the engine pistons when the exhaust valves are opened. As another example, larger valve openings may be desirable during high speed positive power mode operation of the engine, while smaller valve openings may be preferable at lower speed positive power mode operation. Other changes in valve opening and closing trajectories may be desirable under various engine operating conditions. It may also be important to ensure that each valve returns to its seat without undue impact between the valve and seat.

It is therefore another object of this invention to facilitate modifying the stroke lengths and/or other characteristics of the trajectories of the cylinder valves in camless engines depending on various operating parameters of the engine.

It is still another object of this invention to facilitate reducing the impact between a closing valve and its seat in a camless internal combustion engine.

SUMMARY OF THE INVENTION

These and other objects of the invention are accomplished in accordance with the principles of the invention by providing a variable pressure hydraulic system for operating the valves in a camless engine. When the engine is operating in positive power mode, the engine is only required to pump hydraulic fluid to the relatively low pressure needed to open the intake and exhaust valves under positive power mode operating conditions because of the relatively low cylinder pressure that exists when intake or exhaust valves are opened during positive power mode operation. The engine therefore does not waste power pumping the hydraulic fluid to higher pressures. When the engine is switched to compression release engine braking mode operation, however, the engine is required to pump the hydraulic fluid to the much higher pressure needed to open the exhaust valves to produce compression release events because of the much higher cylinder pressure that exists when exhaust valves are to be opened to produce compression release events. Under these conditions it does not matter that the engine must do more work on the hydraulic fluid because it is desired for the engine to absorb as much energy as possible.

In order to modify the engine cylinder valve stroke lengths a sensor may be provided for sensing (directly or indirectly) the amount by which each valve requiring such control is open. This information is fed back to the electronic or computer control for an electrically operated trigger valve that controls the application of pressurized hydraulic fluid to a hydraulic actuator that opens the engine cylinder valve. When the control detects (via the sensor) that the valve has opened by an amount appropriate for current operating conditions of the engine, the control prevents further net influx of hydraulic fluid to the hydraulic actuator, thereby preventing further opening of the engine cylinder valve. The control is responsive to appropriate engine operating conditions and may automatically modify the amounts by which the engine cylinder valves open depending on those operating conditions. Similar techniques may be used for controlling or modifying other characteristics of valve opening and closing trajectories such as the timing, slope, and/or shape of those trajectories in general, and in particular the velocity with which each valve returns to its seat.

Further features of the invention, its nature and various advantages will be more apparent from the accompanying drawings and the following detailed description of the preferred embodiments.

DETAILED DESCRIPTION OF THE PREFERRED EMBODIMENTS

Figure 1:
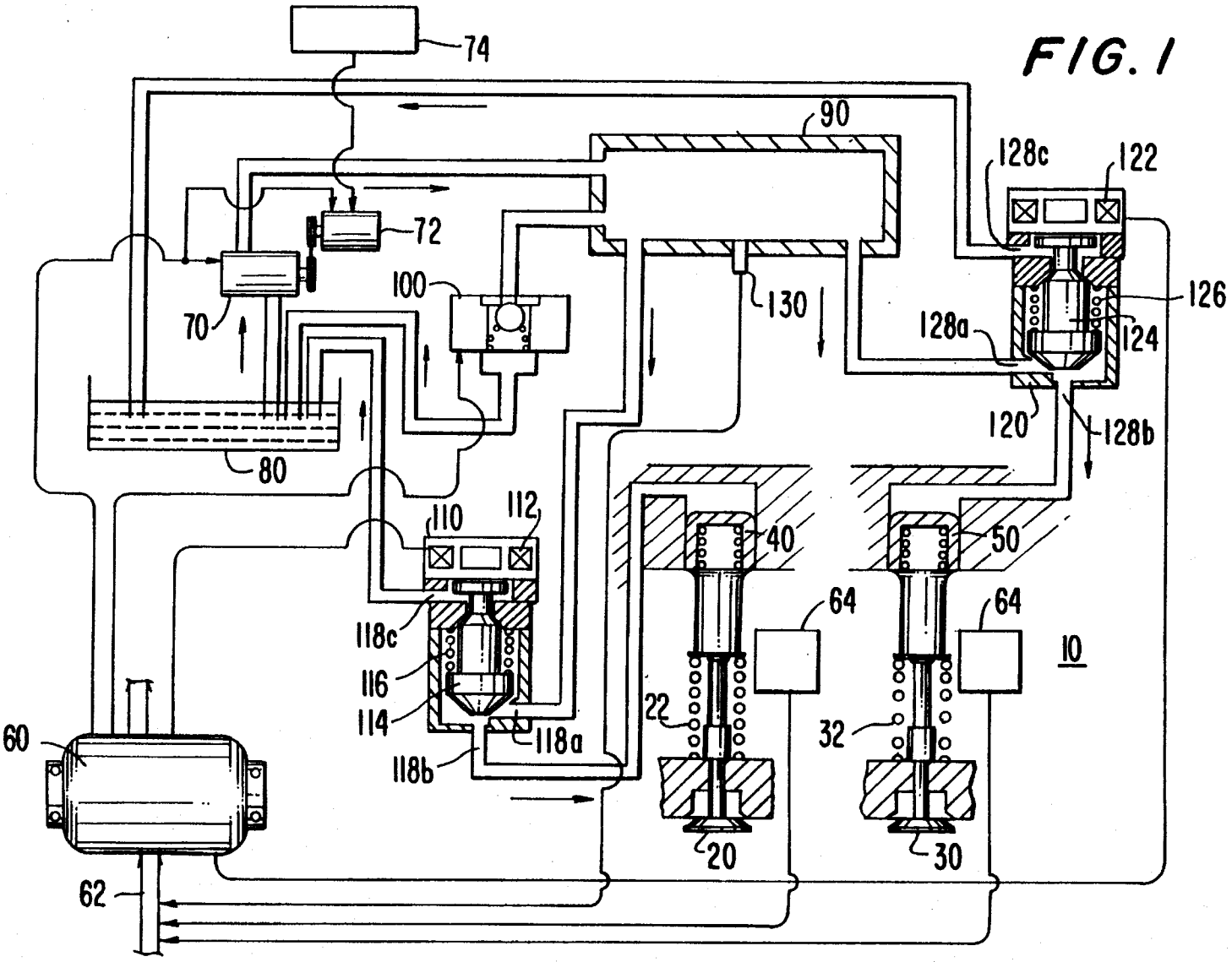
FIG. 1 is a schematic diagram of a representative portion of illustrative camless engine apparatus constructed in accordance with this invention.

In the representative portion of the illustrative camless engine 10 shown in FIG. 1, engine cylinder intake valve 20 is selectively openable by hydraulic actuator 40, and engine cylinder exhaust valve 30 is selectively openable by hydraulic actuator 50. Intake valve 20 is normally held closed by prestressed compression coil return spring 22. Exhaust valve 30 is normally held closed by prestressed compression coil return spring 32. It will be understood that engine 10 typically includes more than one cylinder, and that elements such as 20, 30, 40, and 50 (as well as subsequently described elements 110 and 120) are typically duplicated for each engine cylinder. It will also be understood that engine 10 may have more than one intake and/or exhaust valve per cylinder. Multiple intake valves in a cylinder may be controlled either together by one actuator 40 or separately by separate actuators. Similarly, multiple exhaust valves in a cylinder may be controlled either together by one actuator 50 or separately by separate actuators. Still another possibility is that an additional valve may be provided for use in producing compression release events (see, for example, Gobert et al. U.S. Pat. No. 5,146,890). However, such additional valves are very much like conventional exhaust valves, and so it will be understood that they are included within the term "exhaust valve" or the term "cylinder valve" as those terms are used herein.

Operation of engine 10 is controlled to a large extent by electronic control module 60. Module 60 is preferably a substantially digital controller which receives a plurality of inputs 62 and produces a plurality of output signals for controlling various aspects of the operation of the engine in both positive power mode and compression release engine braking mode. For example, inputs 62 may include such signals as (1) ignition on, (2) fuel supply on, (3) engine crankshaft angle and piston position, (4) engine speed, (5) clutch engaged, (6) transmission gear, (7) vehicle speed, (8) compression release engine braking requested by operator of the vehicle, (9) intake manifold pressure, (10) engine cylinder pressure, (11) ambient air temperature, (12) ambient barometric pressure, (13) automatic or antilock brake system operating condition, (14) the outputs of valve position sensors 64, (15) the hydraulic fluid pressure in plenum 90 as sensed by pressure sensor 130, and/or (16) any other engine or vehicle parameter on which it is desired to base control of engine 10 in either positive power mode or compression release engine braking mode. Control module 60 uses the input information it receives to determine how engine 10 should be controlled and to produce output signals for controlling the system in that manner.

Control module 60 preferably includes a suitably programmed, conventional, digital computer (e.g., a microprocessor augmented by suitable conventional digital memory (containing, for example, program instructions and data for use by the microprocessor)). Input signals 62 typically come from conventional vehicle controls (e.g., electronic engine and/or automatic brake control modules), engine and vehicle instrumentation, and other appropriate sensors. Control module 60 also includes conventional interface circuitry for converting any analog inputs 62 to the digital form required by the microprocessor, and for converting the digital outputs of the microprocessor to any analog forms required for engine control signals. Although a general-purpose microprocessor is preferably used in control module 60, specially designed circuitry may be used instead if desired. Additional information regarding electronic controls of the general type employed herein may be found in commonly assigned U.S. patent applications Ser. No. 08/320,178, filed Oct. 7, 1994, Ser. No. 08/319,734, filed Oct. 7, 1994, and Ser. No. 08/320,049, filed Oct. 7, 1994 (now Hu et al. U.S. Pat. No. 5,479,890), all of which are hereby incorporated by reference herein.

One of the outputs of control module 60 may be a signal for controlling hydraulic pump 70. Pump 70 is generally required to operate whenever engine 10 is turning. Pump 70 may derive the power required to operate it directly from engine 10, or pump 70 may be driven by a separate electric motor 72 powered from the conventional electrical system 74 of the vehicle. In the latter case control module 60 may control motor 72 (e.g., by changing the speed of the motor) rather than controlling pump 70 directly. (The vehicle's electrical system is, of course, ultimately powered by the engine in the conventional manner.) Pump 70 pumps hydraulic fluid (e.g., engine lubricating oil or engine fuel) from a sump 80 to a plenum 90. Thus pump 70 provides the hydraulic fluid pressure required in plenum 90. Relief valve 100 may be provided for helping to maintain a desired hydraulic fluid pressure in plenum 90. For example, if the pressure in plenum 90 becomes too high, relief valve 100 opens to return some hydraulic fluid to sump 80. Relief valve 100 may have an adjustable opening threshold pressure, which may be controlled by another output signal from control module 60.

As mentioned above, intake valve 20 is selectively openable by hydraulic actuator 40. Each time it is desired to open intake valve 20, control module 60 applies a coil-energizing electrical signal to the electromagnet coil 112 of solenoid trigger valve 110. Although a particular trigger valve construction is shown for purposes of illustration in in FIG. 1, it will be understood that many other types of trigger valves can be used instead if desired. For example, in place of the poppet-type valves shown in FIG. 1, spool valves, ball valves, or valves with rotating valve elements may be suitable substitutes. These and other alternatives are illustrated by the trigger valves shown in above-mentioned applications Ser. Nos. 08/320,178 and 08/319,734.

Returning to the illustrative example shown in FIG. 1, energization of coil 112 raises the movable element 114 in valve 110 against the downwardly directed urging of prestressed compression coil return spring 116. With movable element 114 thus raised (as shown in FIG. 1), valve inlet port 118*a* is opened and valve drain port 118*c* is closed. Valve port 118*b* is open at all times. Accordingly, pressurized hydraulic fluid flows from plenum 90 through valve 110 to hydraulic actuator 40 where it drives down the actuator piston to open intake valve 20 (as is also shown in FIG. 1). When it is desired to close valve 20, control module 60 de-energizes the coil 112 of valve 110. This allows spring 116 to move valve element 114 down to the position in which port 118*a* is closed but port 118*c* is open. Hydraulic fluid can then flow out of actuator 40 through valve 110 to sump 80. This allows return spring 22 to raise intake valve 20 to the closed position. It may be desirable to limit the speed at which valve 20 returns to its seat (e.g., to avoid excessive impact force between the valve and seat). This can be accomplished, for example, by using the valve position sensor 64 associated with valve 20 to detect when valve 20 is approaching its seat. Control module 60 can then begin to rapidly open and close valve 110 to slow down the net outflow of hydraulic fluid from actuator 40, thereby slowing down the return of valve 20 to its seat. Valve position sensors 64 are further described below.

The hydraulic circuit for opening exhaust valve 30 is similar to that described above for intake valve 20. Each time it is desired to open exhaust valve 30, control module 60 applies an electrical signal to energize the coil 122 of solenoid trigger valve 120. Any of the alternative constructions of trigger valve 110 mentioned above are equally suitable for trigger valve 120. Energization of coil 122 raises movable valve element 124 (as shown in FIG. 1) and allows pressurized hydraulic fluid to flow from plenum 90 through valve 120 (via ports 128*a* and 128*b*) to hydraulic actuator 50. The pressurized hydraulic fluid drives the piston of actuator 50 down to open exhaust valve 30 (as is also shown in FIG. 1). When it is desired to close valve 30, control module 60 de-energizes trigger valve 120. This allows return spring 126 to lower element 124, thereby closing port 128*a* and opening port 128*c*. Hydraulic fluid can then flow from hydraulic actuator 50 through valve 120 to sump 80, thereby allowing return spring 32 to raise exhaust valve 30 to the closed position. As in the case of valve 20, at least the final portion of the return stroke of valve 30 may be slowed down by using the associated sensor 64 to detect that valve 30 is approaching its seat and by having control module 60 then begin to rapidly open and close valve 120. This slows down the net outflow of hydraulic fluid from actuator 50 and allows valve 30 to return to its seat more slowly and therefore with reduced impact between the valve and the seat.

It will be understood from the foregoing that when positive power mode operation of the engine is desired, control module 60 opens and closes trigger valves 110 and 120—and therefore intake and exhaust valves 20 and 30—at the times (relative to engine crankshaft angle, possibly modified by other appropriate parameters) appropriate for positive power mode operation of the engine (see, for example, FIG. 4, which is discussed in detail below). Similarly, when compression release engine braking is desired, control module 60 opens and closes trigger valves 110 and 120—and therefore intake and exhaust valves 20 and 30—at the times (relative to engine crankshaft angle, possibly modified by other appropriate parameters) appropriate for compression release engine braking mode operation of the engine (see, for example, FIGS. 5 and 6, which are also discussed in detail below).

It will be understood that any of the "times" mentioned in the two preceding sentences can be varied by control module 60 based on changes in any of the inputs (e.g., inputs 62) to that module. For example, it may be desirable to retard compression release events as engine speed increases in order to increase compression release engine braking (this is illustrated, for example, by parameter P in FIG. 5). Or it may be desired to advance power mode intake and exhaust valve openings as engine speed increases (this is illustrated, by example, by parameters A and B in FIG. 4). Control module 60 may make these timing changes by performing a predetermined algorithm whose variables include the currently measured values of the inputs to module 60. Alternatively, control module 60 may use a previously stored look-up table to determine the currently appropriate timings which correspond to current values of the inputs to module 60.

Figure 5:
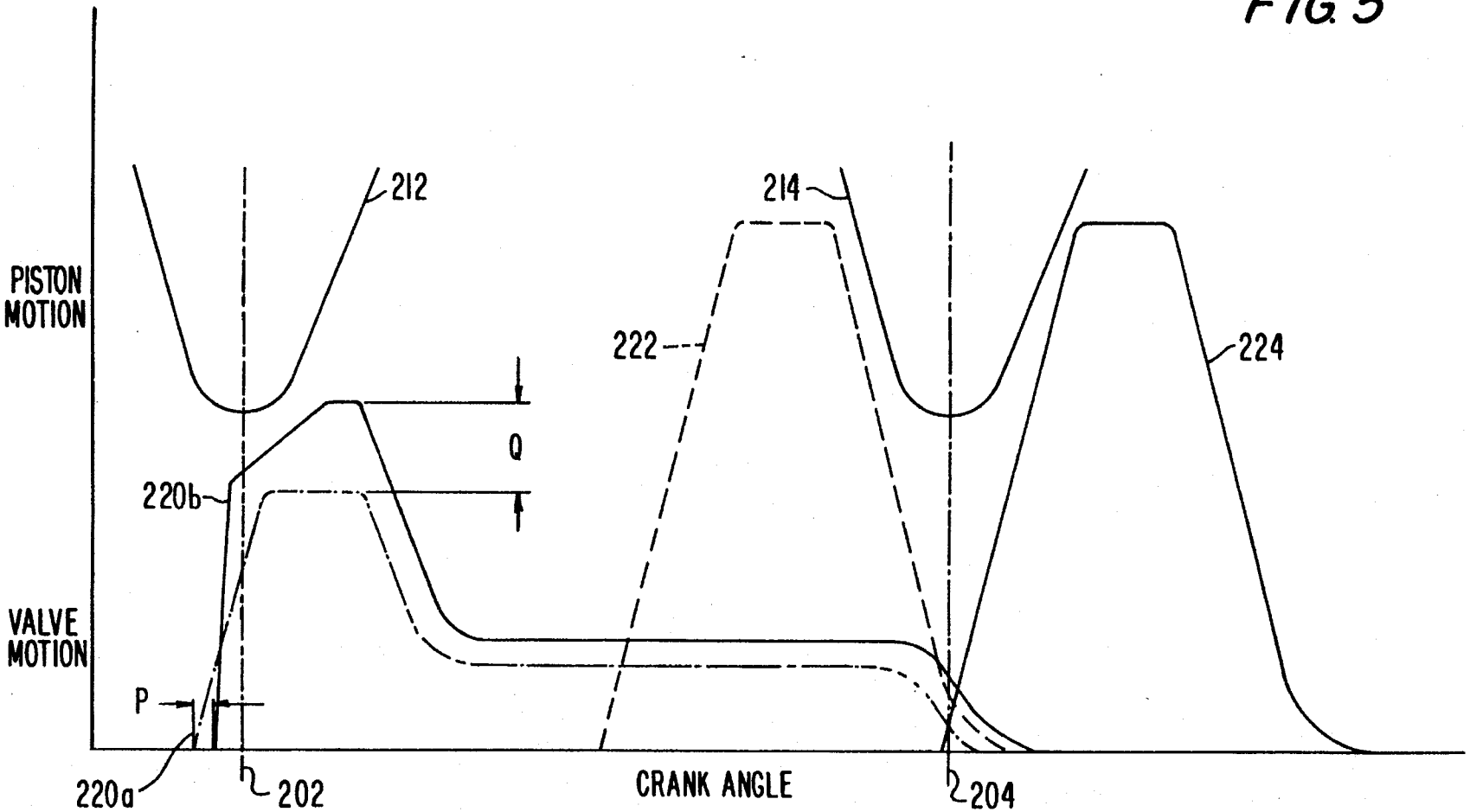
FIG. 5 is a simplified diagram illustrating four-cycle compression release engine braking mode operation of a camless engine in accordance with this invention.
Figure 6:
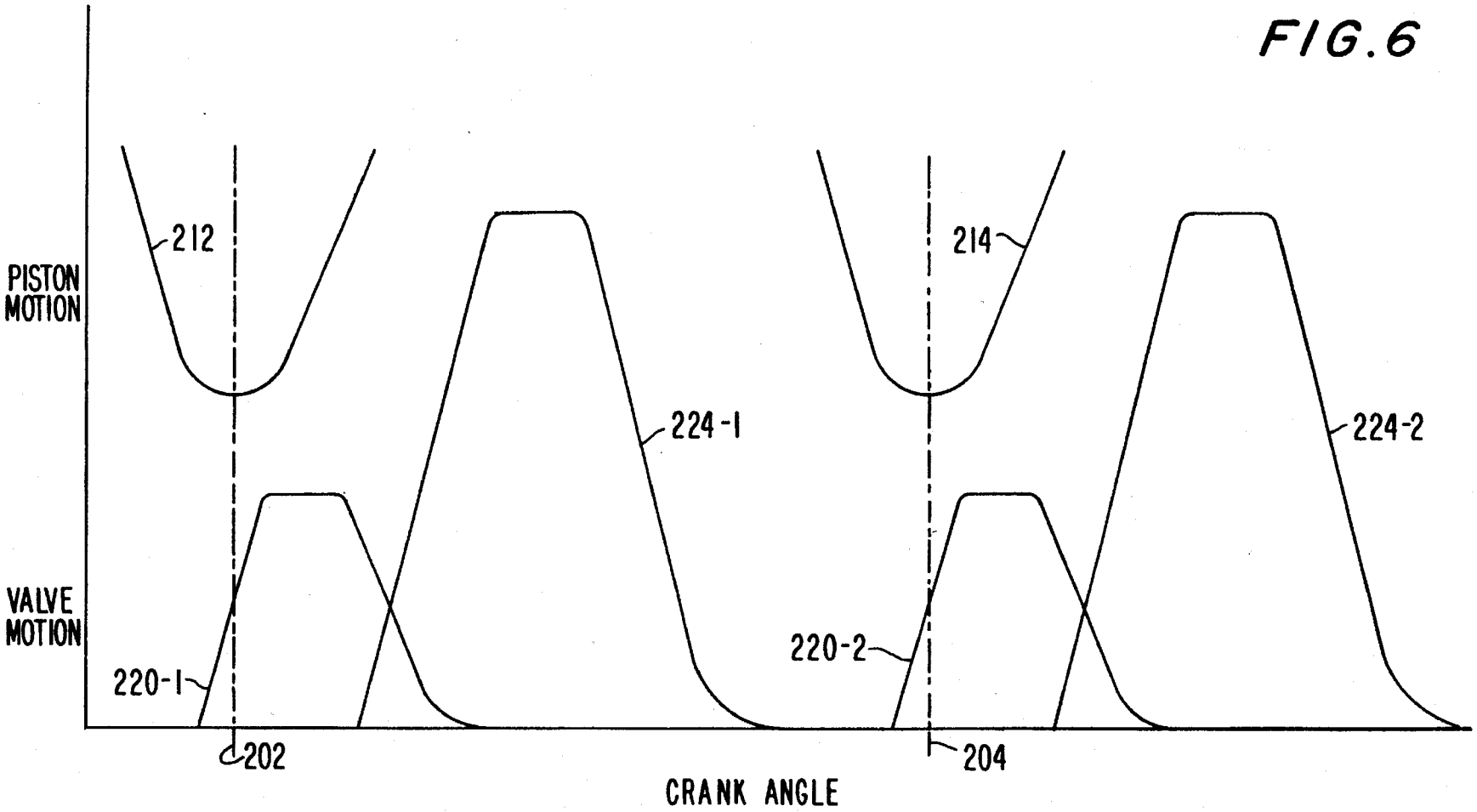
FIG. 6 is a simplified diagram illustrating two-cycle compression release engine braking mode operation of a camless engine in accordance with this invention.

In addition to the relatively small (but nevertheless important) timing changes of the type discussed in the preceding paragraph, control module 60 may make more radical changes in valve timing. For example, control module 60 can control the engine to operate in either four-cycle engine braking mode (in which the engine exhaust valves are opened near top dead center of every other stroke of the associated cylinder as shown in FIG. 5) or in two-cycle engine braking mode (in which the engine exhaust valves are opened near top dead center of every stroke of the associated cylinder as shown in FIG. 6). (In the case of two-cycle engine braking mode, the engine intake valves must also be opened during every stroke of the associated engine cylinder to admit air to the cylinder for two-cycle engine braking. This is also shown in FIG. 6.) Similarly, power mode operation of the engine may be either two-stroke or four-stroke, and the choice of two-stroke or four-stroke operation in power mode can be independent of the choice of two-stroke or four-stroke operation in engine braking mode.

As is explained in the Background section of this specification, the force required to open intake and exhaust valves 20 and 30 during positive power mode operation of the engine is relatively low as compared to the force required to open exhaust valve 30 during compression release engine braking mode operation of the engine. In accordance with the principles of this invention this difference in hydraulic fluid pressure requirement is taken into account by changing the pressure in plenum 90 depending on whether the engine is in positive power mode or compression release engine braking mode. This can be accomplished in any of several ways. For example, control module 60 can control pump 70 to change the output hydraulic pressure produced by the pump. When the engine is in positive power mode, control module 60 applies a signal to pump 70 which causes the pump to pump hydraulic fluid only to the relatively low pressure required to enable actuators 40 and 50 to open valves 20 and 30 for positive power mode operation of the engine. This saves engine horsepower that would otherwise be consumed by pump 70 in pumping fluid to substantially higher pressure. This is true whether pump 70 is powered directly by the engine or is powered electrically from the vehicle's electrical system 74. On the other hand, when compression release engine braking is required, control module 60 causes pump 70 to work harder and pump hydraulic fluid to the much higher pressure required to open exhaust valve 30 to produce compression release events. Under these conditions it does not matter that pump 70 consumes more engine horsepower (either directly from the engine or via the electrical system 74 of the vehicle) because it is desired for the engine to dissipate as much power as possible.

As an alternative to changing the pressure produced by pump 70 as described above, control module 60 can control the threshold pressure at which plenum relief valve 100 opens to relieve hydraulic fluid pressure in plenum 90. During positive power mode operation of the engine, control module 60 applies a signal to relief valve 100 to cause the threshold pressure of that valve to be relatively low. This prevents the backpressure on pump 70 from being unnecessarily high and thus prevents the pump from working unnecessarily hard to pump hydraulic fluid to a high pressure. Internal consumption of engine horsepower is thereby reduced and more horsepower is made available for useful, vehicle-propelling output. On the other hand, when compression release engine braking is desired, control module 60 raises the threshold pressure at which relief valve 100 opens. This raises the hydraulic fluid pressure in plenum 90 so that exhaust valve 30 can be opened to produce compression release events. Pump 70 must work harder under these conditions, but this is not a problem or even a disadvantage because maximum power dissipation is now desired.

Another illustrative technique for automatically adjusting hydraulic fluid pressure as described above involves controlling both pump 70 and relief valve 100 in the manner which has just been explained. Still another illustrative technique involves allowing relief valve 100 to operate only during power mode operation of the engine. In this embodiment control module 60 locks relief valve 100 closed during compression release engine braking operation of the engine. (Alternatively, control module 60 could close an on-off solenoid valve upstream or downstream from relief valve 100 during compression release engine braking. This would prevent relief valve 100 from relieving the pressure in plenum 90, thereby causing the plenum pressure to rise to the high level required to produce compression release events.)

FIG. 1 also illustrates another feature of the invention that can be provided if desired. It may be advantageous to control the amounts by which engine intake valves 20 and/or exhaust valves 30 open under various engine operating conditions. For example, during positive power mode operation of the engine it may be beneficial to open valves 20 and 30 wider at higher engine speeds than at lower engine speeds. (Changes of this type are illustrated by the variables C and D in FIG. 4.) Similarly, during compression release engine braking mode it may be desirable to vary the amount by which valves 30 open to produce compression release events based on such parameters as engine speed. (Changes of this type are illustrated by the variable Q in FIG. 5.)

In accordance with this invention, if it is desired to provide such control of the engine cylinder valve strokes, sensors 64 may be used to sense the amount by which valves 20 and/or 30 are open. For example, each sensor 64 may be a detector for sensing the amount of travel of an associated hydraulic actuator 40 or 50 or the amount of travel of the associated valve mechanism 20 or 30. The output signal of each sensor 64 is applied to control module 60. Control module 60 uses the data from sensors 64 to control trigger valves 110 and/or 120 so that valves 20 and/or 30 are opened by amounts that are appropriate for the current operating conditions of the engine. For example, when control module 60 detects (via a sensor 64) that a valve 20 or 30 has opened by a currently desired amount, control module 60 may begin to rapidly and repeatedly close and open the associated trigger valve 110 or 120 so that there is no further net flow of hydraulic fluid from plenum 90 to the hydraulic actuator 40 or 50 controlled by that trigger valve. This prevents further opening of the valve 20 or 30, thereby holding that valve at the desired amount of opening. Sensors 64, control module 60, and trigger valves 110 and/or 120 therefore constitute feedback loops for controlling the amounts by which valves 20 and/or 30 open, and control module 60 can vary these amounts depending on various engine operating conditions as detected via other inputs 62 to the control module.

Described another way, control module 60 determines the amount by which each engine cylinder valve 20 and/or 30 should be allowed to open under the engine operating conditions currently detected by control module 60 via one or more of its inputs 62. For example, inputs 62 on which control module 60 may base its determination of appropriate valve stroke length can be engine speed and/or an indication of whether the engine is in positive power mode or compression release braking mode. Control module 60 may make this determination of valve stroke length by using a look-up table previously stored in a memory of the control module or by performing a predetermined algorithm. When an engine cylinder valve 20 or 30 is to be opened, control module 60 opens the associated trigger valve 110 or 120 until the associated sensor 64 indicates that the engine cylinder valve has opened by the desired amount. Thereafter control module 60 controls the trigger valve 110 or 120 so that there is no further net flow of hydraulic fluid to the actuator 40 or 50 associated with the engine cylinder valve. This holds the engine cylinder valve open by the desired amount. When it is time to close the engine cylinder valve, control module 60 de-energizes the associated trigger valve 110 or 120, thereby allowing the associated actuator 40 or 50 to drain. As described in detail earlier, control module 60 may use the sensor 64 associated with each engine cylinder valve to detect when that valve is approaching its seat and to then again begin rapidly opening and closing the associated valve 110 or 120 to slow down the engine cylinder valve as it closes. As engine operating conditions change, control module 60 automatically changes the strokes of the engine cylinder valves controlled as described above.

Another type of trigger valve 110 or 120 that may be used to facilitate variable engine cylinder valve stroke control is a three-position trigger valve (e.g., a three-position spool valve). Such a valve has an "off" position in which the associated hydraulic actuator 40 or 50 is connected to hydraulic fluid drain 80, an "on" position in which the associated hydraulic actuator 40 or 50 is connected to pressurized hydraulic fluid source 90, and an intermediate "hold" position in which the associated hydraulic actuator 40 or 50 is sealed off so that it can neither receive additional pressurized hydraulic fluid from source 90 nor vent to sump 80. Control module 60 places such a trigger valve in the "hold" position as soon as the associated sensor 64 indicates that the associated engine cylinder valve has opened by the currently desired amount.

Figure 2:
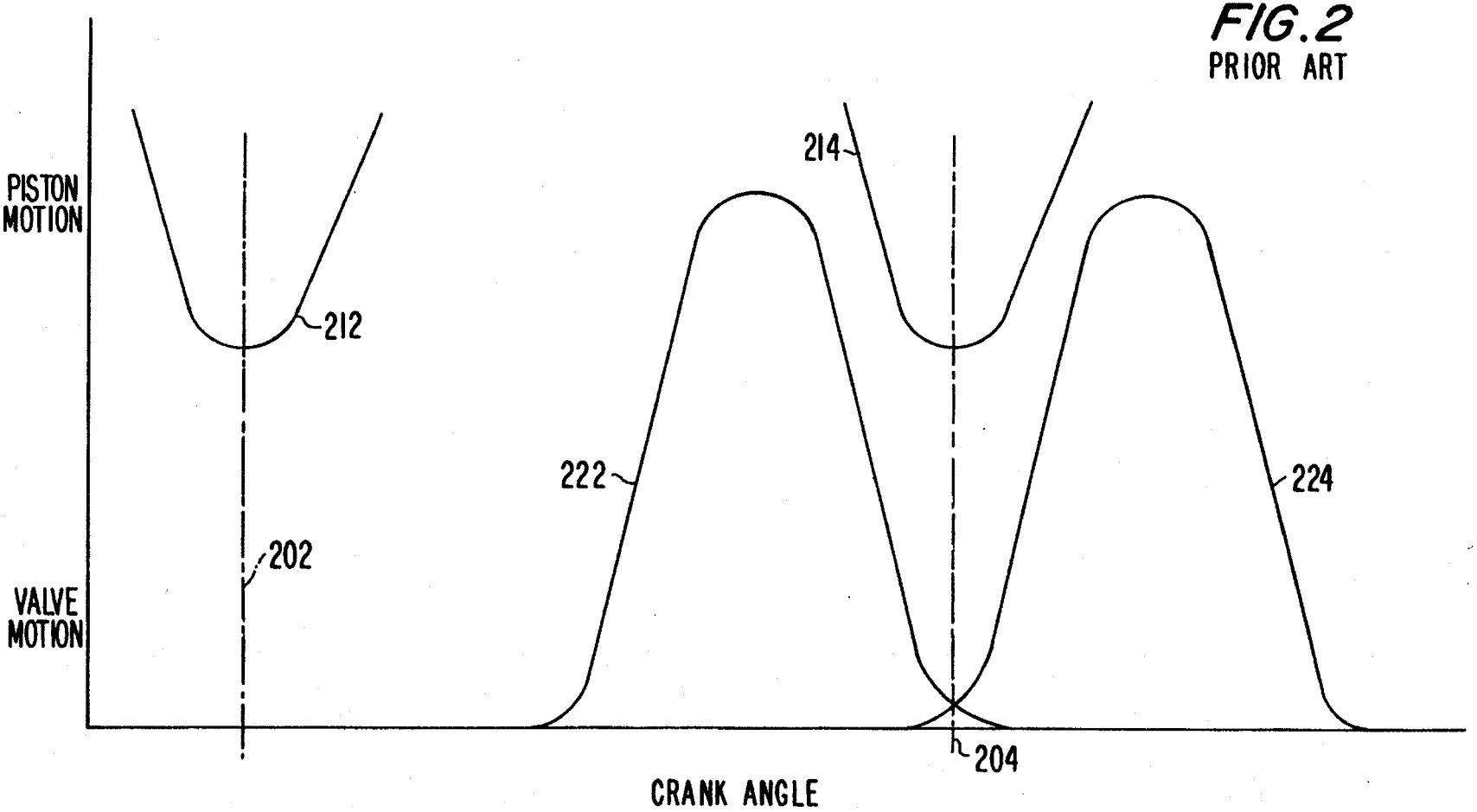
FIG. 2 PRIOR ART
FIG. 2 is a simplified diagram showing conventional, cam-driven, intake and exhaust valve motion in a conventional four-cycle internal combustion engine operating in power mode.
Figure 3:
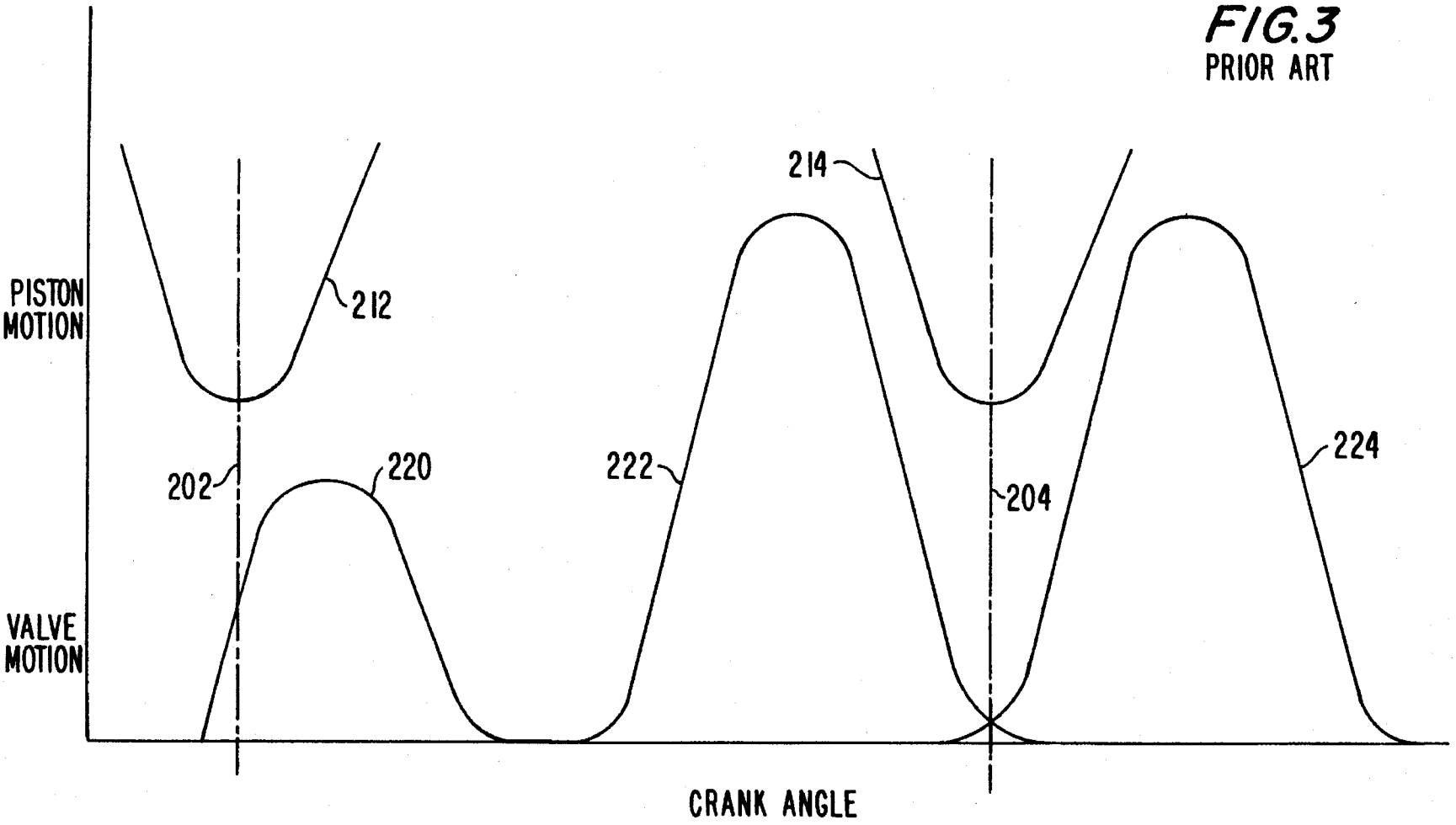
FIG. 3 PRIOR ART
FIG. 3 is similar to FIG. 2 but shows conventional intake and exhaust valve motion in conventional four-cycle compression release engine braking mode.

FIGS. 2 and 3 illustrate typical conventional valve actuation in a four-cycle engine in power mode (FIG. 2) and compression release engine braking mode (FIG. 3). These FIGS. are included for comparison with FIGS. 4–6, which show various types of valve actuation that are possible with the above-described apparatus of this invention.

In FIG. 2 top dead center of an engine cylinder compression stroke is indicated by line 202, and top dead center of the subsequent exhaust stroke is indicated by line 204. Engine piston motion is partly indicated by curves 212 and 214. A conventional, cam-driven, exhaust valve opening is indicated by curve 222, and a conventional, cam-driven, intake valve opening is indicated by curve 224.

FIG. 3 is similar to FIG. 2, except that because it illustrates conventional compression release engine braking mode operation, curve 220 is added to show the additional exhaust valve opening that the compression release engine brake produces near top dead center 202 of each compression stroke.

In general, all of curves 220, 222, and 224 in FIGS. 2 and 3 are necessarily of fixed size, shape, and timing. The fact that at least curves 222 and 224 are produced by cam mechanisms also limits the valve accelerations and decelerations that are acceptable. Thus, each of curves 222 and 224 must start up gradually to avoid abrupt impact between the cam and cam follower. Similarly, each of curves 222 and 224 must gradually reverse direction at the top of the valve stroke to avoid separation of the cam follower from the cam. (A gradual return of each curve 220, 222, and 224 to zero valve displacement is always desirable to avoid excessively abrupt reseating of each valve.)

Figure 4:
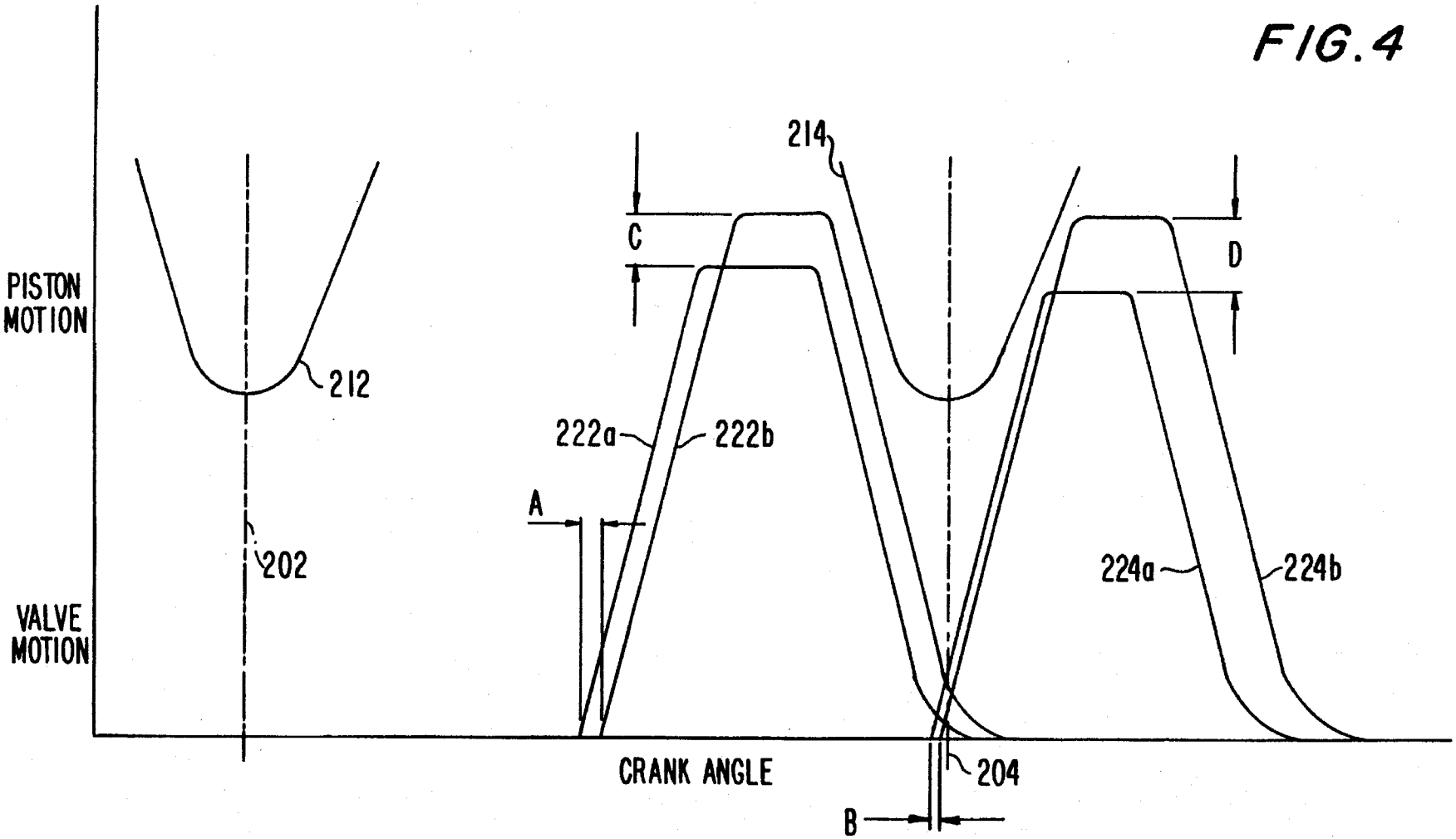
FIG. 4 is a simplified diagram illustrating four-cycle power mode operation of a camless engine in accordance with this invention.

FIG. 4 shows positive power mode operation of an engine having camless valve operation in accordance with this invention as described above. Accordingly, FIG. 4 is to be compared to FIG. 2. FIG. 4 shows that with this invention the size, shape, and timing of the valve openings and closings can be readily varied. For example, curves **222*a* and 222*b* show just two of the many possible opening and closing trajectories (as a function of engine crank angle) of an exhaust valve. curves 224*a* and 224*b* show two of the many possible opening and closing trajectories (as a function of engine crank angle) of an intake valve. Parameters such as A and B in FIG. 4 indicate that the timing of each valve opening can be changed as described above in connection with FIG. 1. Parameters such as C and D indicate that the height of each valve opening can also be changed as is also described in connection with FIG. 1**. Moreover, all of these (and other) changes can be made independently of one another.

FIG. 5 shows camless, four-cycle, compression release engine braking mode operation in accordance with this invention. FIG. 5 is therefore to be compared to FIG. 3. The phantom line 222 shows that the normal, power mode, exhaust valve opening can be completely eliminated during camless compression release engine braking if desired. FIG. 5 also shows by means of curves **220*a* and 220*b* that the compression release opening and closing of the exhaust valve can be modified in many different ways to optimize that valve motion for various engine and/or vehicle operating conditions. For example, parameter P indicates one representative respect in which the timing of this valve opening can be modified. Similarly, parameter Q indicates one respect in which the height of this valve opening can be modified. Curves 220*a* and 220*b* may have the depicted, long, rightwardly extending tails which represent a prolonged, relatively small, "bleeder opening" that may advantageously follow the larger initial opening of the exhaust valve during compression release engine braking in accordance with this invention. Curves 220*a* and 220*b* also have different slopes and/or shapes that are optimized in various respects for different engine and/or vehicle operating conditions. Again, all of these various modifications of the exhaust valve opening and closing trajectories for compression release engine braking are readily produced by the apparatus of this invention as described above in connection with FIG. 1. Changes in the slope of valve opening trajectories can be produced, for example, by having control module 60 rapidly open and close, with a different frequency or duty cycle, the associated valve 110 or 120 that controls the flow of hydraulic fluid to the associated valve actuator 40 or 50. Increasing the duty cycle (longer valve openings interspersed with shorter valve closings) increases the steepness of the slope of the associated engine cylinder valve opening. Decreasing the duty cycle (shorter valve openings interspersed with longer valve closings) decreases the steepness of the slope of the associated engine cylinder valve opening. Similar modulation of the operation of valve 110 or 120 can be used to control the slope of valve closings as was described in more detail earlier in this specification. Techniques such as these allow control module 60 to produce fairly complicated and varied engine cylinder valve openings and closings such as are shown by curves 220 in FIG. 5**.

FIG. 6 shows two-cycle camless engine braking in accordance with this invention. For example, the apparatus of this invention may convert the engine from camless four-cycle power mode operation as shown in FIG. 4 to camless two-cycle compression release engine braking mode operation as shown in FIG. 6. As FIG. 6 shows, each time the engine cylinder is approaching a top dead center condition 202 or 204, an exhaust valve opening 220 is produced to cause a compression release event. In addition, during each downstroke of the piston, an intake valve opening 224 is produced. Thus all normal power mode exhaust valve openings are completely eliminated in FIG. 6, and an additional intake valve opening 224-1 is added.

FIGS. 4–6 also illustrate the point that the camless valve openings of this invention are not constrained to have the gradual start and gradual direction reversal that is required for cam-driven valve openings as shown in FIGS. 2 and 3. Thus the valve openings shown in FIGS. 4–6 can have more abrupt and more precisely timed starts, as well as flat peaks with well-defined shoulders, if desired. FIGS. 4–6 also show the gradual return of each valve to its seat which can be produced by the apparatus of this invention as has been described above.

It will be understood that the foregoing is only illustrative of the principles of the invention, and that various modifications can be made by those skilled in the art without departing from the scope and spirit of the invention. For example, a number of other types of electrically operated hydraulic trigger valves are mentioned above as possible replacements for depicted poppet-type solenoid valves 110 and 120.

The invention claimed is:

1. Internal combustion engine apparatus capable of operating in either positive power mode or compression release engine braking mode, said engine including engine cylinder valves, a hydraulic actuator respectively associated with each of said valves for selectively opening at least some of said valves during positive power mode and compression release engine braking mode, a source of pressurized hydraulic fluid for selective application to said hydraulic actuators, and hydraulic fluid pressure controls for controlling the pressure of said hydraulic fluid from said source so that said pressure is relatively low during positive power mode and relatively high during compression release engine braking mode.

2. The apparatus defined in claim 1 wherein said controls include a computer, programmed to detect whether said engine is in positive power mode or compression release engine braking mode and to produce an output for controlling said pressure of said hydraulic fluid from said source depending on whether said engine is in positive power mode or compression release engine braking mode.

3. The apparatus defined in claim 1 wherein greater hydraulic fluid pressure is required to open at least some of said valves during compression release engine braking mode than is required to open valves during positive power mode.

4. The apparatus defined in claim 1 wherein said source is powered by said engine.

5. The apparatus defined in claim 4 wherein said source requires more power from said engine when said controls cause hydraulic fluid pressure from said source to be relatively high than when said controls cause hydraulic fluid pressure from said source to be relatively low.

6. The apparatus defined in claim 1 wherein said source includes an electrically driven hydraulic pump.

7. The apparatus defined in claim 6 wherein said internal combustion engine is disposed in a vehicle propelled by said engine, said vehicle having an electrical system that is powered by said engine, and wherein said electrically driven hydraulic pump is powered from said electrical system.

8. The apparatus defined in claim 1 further comprising an electrically controlled hydraulic valve respectively associated with each of said hydraulic actuators, each of said hydraulic valves being hydraulically connected between said source and the associated hydraulic actuator for controlling the flow of hydraulic fluid from said source to said hydraulic actuator.

9. The apparatus defined in claim 8 wherein each of said hydraulic valves allows hydraulic fluid to flow from the associated hydraulic actuator when the hydraulic valve is not positioned to allow hydraulic fluid to flow from said source to said hydraulic actuator.

10. The method of operating an internal combustion engine in either positive power mode or compression release engine braking mode, said engine including engine cylinder valves, and a hydraulic actuator respectively associated with each of said valves for selectively opening at least some of said valves during positive power mode and compression release engine braking mode, said method comprising the steps of:

selectively applying relatively low pressure hydraulic fluid to said hydraulic actuators during positive power mode; and selectively applying relatively high pressure hydraulic fluid to said hydraulic actuators during compression release engine braking mode.

11. The method defined in claim 10 wherein said hydraulic fluid is applied to said hydraulic actuators from a source of pressurized hydraulic fluid, and wherein said steps of selectively applying include the step of:

changing the pressure of the hydraulic fluid source from a relatively low pressure to a relatively high pressure depending on whether positive power mode or compression release engine braking mode, respectively, is desired.

12. Internal combustion engine apparatus comprising:

an internal combustion engine including a plurality of engine cylinder valves;

a plurality of hydraulic actuators, each of which is associated with a respective one of said engine cylinder valves for opening the associated engine cylinder valve when pressurized hydraulic fluid is supplied to said actuator;

a source of pressurized hydraulic fluid;

a plurality of electrically operated trigger valves, each of which is associated with a respective one of said actuators for selectively supplying pressurized hydraulic fluid from said source to the associated actuator when said trigger valve is so controlled by a control signal applied to said trigger valve;

a plurality of sensors, each of which is associated with a respective one of said engine cylinder valves for producing an output signal indicative of the amount by which the associated engine cylinder valve is open; and a control for said trigger valves, said control being responsive to the output signals of said sensors for applying said control signals to said trigger valves so that each actuator receives a net influx of hydraulic fluid from the associated trigger valve to cause opening of the associated engine cylinder valve until said control detects that the sensor associated with said engine cylinder valve is indicating that said engine cylinder valve has opened by a particular amount.

13. The apparatus defined in claim 12 wherein said control includes a computer programmed to produce said control signals in response to said output signals of said sensors.

14. The apparatus defined in claim 12 wherein said control is responsive to at least one engine operating condition in addition to said sensor output signals, and wherein said control automatically varies said particular amount on the basis of said engine operating condition.

15. The apparatus defined in claim 14 wherein said engine operating condition is engine speed.

16. The apparatus defined in claim 14 wherein said engine operating condition is which of positive power mode and compression release engine braking mode said engine is currently operating in.

17. The apparatus defined in claim 14 wherein said control includes a computer programmed to produce said control signals in response to said output signals of said sensors and in response to said at least one engine operating condition in addition to said sensor output signals.

18. The method of controlling the length of the stroke of an engine cylinder valve in an internal combustion engine in which said engine cylinder valve is opened by a hydraulic actuator to which pressurized hydraulic fluid is selectively applied to open said engine cylinder valve, said method comprising the steps of:

determining a current maximum amount by which said engine cylinder valve should open;

sensing a current amount by which said engine cylinder valve is currently open;

comparing said current amount to said current maximum amount; and stopping net flow of pressurized hydraulic fluid to said actuator when said current amount is approximately equal to said current maximum amount.

19. The method defined in claim 18 wherein said determining step comprises the steps of:

monitoring at least one variable operating condition of said engine; and modifying said current maximum amount based on variations in said operating condition.

20. Internal combustion engine apparatus including engine cylinder valves, a hydraulic actuator respectively associated with each of said valves for selectively opening at least some of said valves, a source of pressured hydraulic fluid for selective application to said hydraulic actuators, and hydraulic fluid controls for controlling the net flow of said hydraulic fluid from said source to each of said hydraulic actuators to vary the valve lift versus engine crank angle slope of the valve opening trajectory that each of said hydraulic actuators imparts to the associated valve.

21. The apparatus defined in claim 20 wherein said hydraulic fluid controls include means for varying the pressure of the hydraulic fluid in said source.

22. The apparatus defined in claim 20 wherein said hydraulic fluid controls include an electrically operated hydraulic fluid flow control valve connected between said source and each of said hydraulic actuators for selectively allowing pressurized hydraulic fluid to flow from said source to the hydraulic actuator associated with said electrically operated valve.

23. The apparatus defined in claim 22 wherein said hydraulic fluid controls further include means for varying the duty cycle of each said electrically operated valves.

24. The apparatus defined in claim 20 wherein said hydraulic fluid controls are responsive to a variable operating condition of the engine and vary the net flow of said hydraulic fluid from said source to each of said hydraulic actuators in response to variation in said operating condition of said engine.

25. The apparatus defined in claim 24 wherein said variable operating condition of said engine includes engine speed.

26. Internal combustion engine apparatus including engine cylinder valves, a hydraulic actuator respectively associated with each of said valves for selectively opening and closing the associated valve, a sensor respectively associated with each of said valves for producing an output indication of the amount by which said associated valve is open, and hydraulic fluid flow controls responsive to said output indications for controlling net flow of hydraulic fluid to and from each of said actuators to produce a predetermined opening and closing trajectory of the associated valve as a function of engine crank angle.

27. The apparatus defined in claim 26 wherein each of said output indications includes a seat approach indication indicating that the associated valve is approaching its valve seat, and wherein said hydraulic fluid flow controls are responsive to said seat approach indication for each valve by reducing the rate of net hydraulic fluid flow from the hydraulic actuator associated with said valve to reduce the impact of said valve on its valve seat.

* * * * *